United States Patent [19]

Gronseth

[11] 3,994,511

[45] Nov. 30, 1976

[54] ACCESSORY FOR CROSS-COUNTRY SKIS

[76] Inventor: George W. Gronseth, Box 200 - Rte. No. 1, Suttons Bay, Mich. 49682

[22] Filed: June 23, 1975

[21] Appl. No.: 589,351

[52] U.S. Cl. ..... 280/614; 280/11.37 E; 280/637

[51] Int. Cl.[2] ..... A63C 9/00

[58] Field of Search ..... 280/11.35 N, 11.37 E, 280/11.37 R, 11.35 R, 11.35 A, 11.35 C, 11.35 Y, 11.35 D, 11.35 E, 611, 637, 614, 615

[56] References Cited

UNITED STATES PATENTS

| | | | |
|---|---|---|---|
| 899,963 | 9/1908 | Ferguson | 280/11.36 X |
| 2,517,919 | 8/1950 | Pennybacker | 280/11.35 R |
| 2,819,907 | 1/1958 | Thoresen | 280/7.13 |
| 2,933,324 | 4/1960 | Stimler | 280/11.37 E X |
| 2,950,118 | 8/1960 | Sharpe | 280/11.35 R X |
| 3,439,387 | 4/1969 | Churches | 280/11.37 R X |
| 3,452,999 | 7/1969 | Salomon | 280/11.35 N |
| 3,506,279 | 4/1970 | Lambert | 280/11.37 J |
| 3,514,119 | 5/1970 | Sutherland | 280/11.35 C |
| 3,775,866 | 12/1973 | Marker | 280/11.35 K X |

FOREIGN PATENTS OR APPLICATIONS

| | | | |
|---|---|---|---|
| 279,445 | 3/1970 | Austria | 280/11.35 N |
| 908,397 | 9/1945 | France | 280/11.35 N |
| 426,891 | 11/1947 | Italy | 280/11.37 R |
| 191,261 | 8/1937 | Switzerland | 280/11.37 E |

*Primary Examiner*—Philip Goodman
*Assistant Examiner*—Milton L. Smith
*Attorney, Agent, or Firm*—Price, Heneveld, Huizenga & Cooper

[57] ABSTRACT

The specification discloses a strap assembly for stabilizing, supporting, and providing greatly improved control and maneuvering for a skier skiing downhill terrain on cross-country skis as well as other skis without bindings which hold a ski boot in a rigid, fixed position on a ski. The assembly includes a nonstretchable strap for connection between the skier's leg and the front area of the ski ahead of the binding. A selectively connectable elastic strap section is included along the length of the nonstretchable strap to allow full, unhindered motion of the skier's leg for traversing level and uphill terrain on cross-country skis.

14 Claims, 8 Drawing Figures

ACCESSORY FOR CROSS-COUNTRY SKIS

BACKGROUND OF THE INVENTION

This invention relates to skiing equipment and, more particularly, to apparatus for improving one's control and maneuverability on skis such as cross-country snow skis which are not rigidly and inflexibly secured to a ski boot.

In recent years, there has been a tremedous increase in the numbers of persons enjoying cross-country skiing in the United States and other countries even though the cross-country form of skiing has been widely known for hundreds of years. In cross-country skiing, a skier generally utilizes lighter skis than are common to downhill skiing to traverse all types of terrain including uphill and downhill sections. A cross-country skier typically wears lighter, more flexible boots than in conventional downhill or "Alpine" skiing. These more flexible boots are typically attached to the central portion of the skis generally via the toe portions such that the boot can be flexed upwardly to allow the skier to "walk" on his skis to traverse level and uphill areas.

A major problem encountered by virtually all cross-country skiers, both novice and expert alike, is the inability to adequately control one's skis during downhill runs. Unlike typical downhill skiing in which a skier's foot is encased in a generally rigid, inflexible boot which is in turn rigidly secured to his downhill ski so that neither the toe nor heel portions can move from the ski, the heels of the cross-country skier can move with respect to the ski thereby greatly reducing the cross-country skier's ability to control his ski to turn, avoid obstacles, and the like.

To help provide better control, cross-country skis include pads or projections under the heel of the boot to reduce lateral movement of the ski boot with respect to the ski. Use of such pads or projections is often very difficult because the skier's weight must be radically shifted to his heel to make proper use of the pads or projections. When weight is shifted in such manner, the skier's balance is often disrupted, making it difficult or even impossible to perform many of even the simpler maneuvers that are typically performed on downhill-type skis.

Although many types of bindings and safety straps have been designed for use with various types of ski equipment in the past, none have provided the control and maneuverability for cross-country skiers as does the present invention. Safety harnesses have been devised which extend either from the rear of the ski or both the rear and front portions of a ski around the torso of a skier. Other devices include elastic straps extending between the ankles of the skier or between the ski and the ski boot. None of these devices is useful in the manner of the present invention and, in fact, many are dangerous in that they severely limit the ability of the skier to maneuver, keep his balance, and generally control himself on skis.

The present invention provides a device which is uniquely designed for use with cross-country type skis which extends both the range and scope of the type of cross-country skiing which can be performed and enables the enjoyment of downhill-type skiing with conventional cross-country skis and equipment.

SUMMARY OF THE INVENTION

Accordingly, the present invention is an accessory especially adapted for use with conventional cross-country ski equipment and other skis utilizing bindings which do not hold a skier's boot in a firm, rigidly fixed position with respect to the ski at all times. It provides greater control, maneuverability, turning ability, balance and range for a cross-country skier especially when he is skiing downhill terrain.

In its broader aspects, the invention includes an elongated, nonlongitudinally stretchable strap assembly adapted to be connected between the top surface of a ski, generally intermediate the binding are of the ski and the front ski tip, and the skier's leg preferably immediately below the skier's knee. Fastening the strap in such manner allows the skier to lean back and shift his weight to the heels of his boots from the knee joints thereby allowing the boots to firmly engage the projections or pads therebeneath. The boot may thus be firmly positioned with respect to the ski to allow control and maneuverability of the ski.

With the invention, pressure can be exerted on the heel of the boot for greatly improved maneuverability without the skier losing his balance and for better recovery when the skier does lose his balance. Certain ski tricks, which could previously be performed only when using downhill equipment, can now be successfully performed with conventional cross-country equipment and the present invention. In addition, fastening of the strap in the above manner enables the front portions of the skis to be flexed and lifted off the snow or support surface to enable easier and improved carved, skid, snowplow, and other turns, better balance and stability when skiing in varying terrain and snow conditions, and better leverage in deep powder snow conditions.

Not only does the strap assembly provide better control, maneuverability, and turning, but is easily converted to allow uphill or level "walking" on cross-country skis without removing the device from the skis. Such conversion is accomplished by utilizing an elastic strap section in the preferred embodiment which is selectively connectable in the nonstretchable strap as desired in order to switch from downhill to cross-country type skiing.

The present strap assembly invention is useful by all levels of skiers, both novice and expert. It actually becomes more useful as proficiency is gained. It does not interfere with normal cross-country maneuvers or movements, is economical because one size fits virtually all equipment, and both skis in any one pair, and does not require special equipment or modification of present cross-country equipment for installation. Further, installation and removal is simple and rapid.

These and other objects, advantages, purposes, and features of the invention will become more apparent from a study of the following description taken in conjunction with the drawings.

DESCRIPTION OF THE PREFERRED EMBODIMENT

Figure 1:
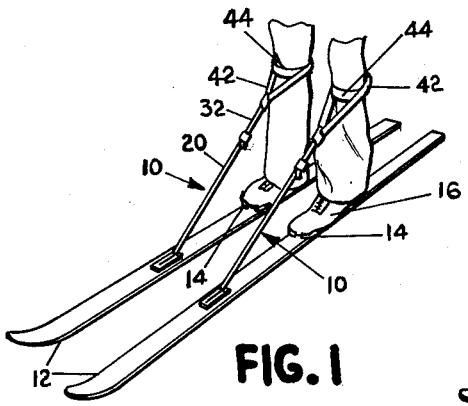
FIG. 1 is a perspective view of a skier on a pair of cross-country skis including the present invention connected between the area between the binding and the front tip of each ski and that portion of each of the skier's legs immediately below his or her knees, the strap assembly being shown in its taut, nonstretchable condition for use in skiing downhill terrain.
Figure 2:
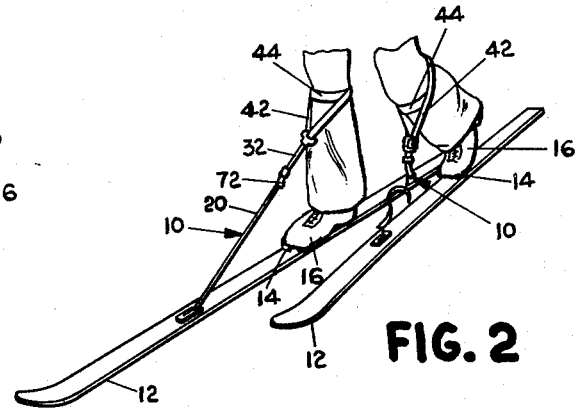
FIG. 2 is a perspective view of a skier on a pair of cross-country skis using the present invention wherein the strap assembly is in its elastic condition when the skier is "walking" or traversing level or uphill terrain.
Figure 6:
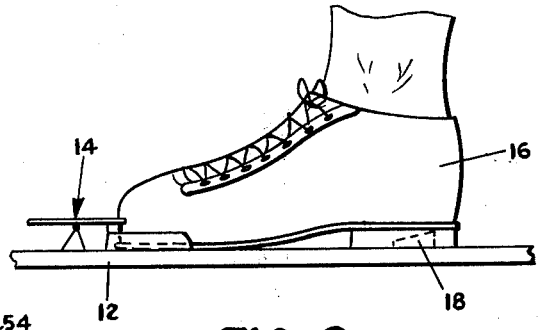
FIG. 6 is a fragmentary, side elevation of a typical cross-country ski boot and binding with the skier's weight shifted to the heel of the boot while using the invention to engage a projection thereunder to allow control of the ski.

Referring now to the drawings in greater detail, FIGS. 1 and 2 illustrate the present invention including a pair of strap assemblies 10 each of which is secured to a single cross-country ski 12. Typically, corss-country skis 12 are of a thinner, lighter variety than downhill skis and are formed from wood, fiberglass, or combinations thereof. Each ski 12 includes a binding 14 which engages the front of a cross-country ski boot 16 as shown in FIGS. 1, 2, and 6. Cross-country ski boots 16 are of a lighter, more flexible variety than are conventional downhill ski boots and typically include a thin, flexible sole which may be easily flexed under the ball of the skier's foot. As shown in FIG. 6, the cross-country ski binding 14 engages the front portion of the boot and the top of the ski boot sole at the front to firmly and fixedly hold only the front portion of the boot to the ski. Accordingly, the heel portion of the boot, and generally all portions rearward of the binding 14, can be flexed upwardly while the front remains fixed to the ski as shown in FIG. 2.

Figure 7:
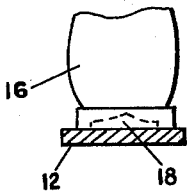
FIG. 7 is an end elevation of the ski boot, ski, and projection shown in FIG. 6.

In addition, cross-country ski equipment also typically includes a projection or pad 18 (FIGS. 6 and 7) secured to the ski beneath the heel of the cross-country boot 16. When the skier shifts his weight to plant the heels of his boots firmly on the skis, the projection or pad 18 mates with the boot heel to prevent lateral movement of the boot heel with respect to the ski to enable the skier to control the direction of the ski for turns, maneuvers, and the like. As described above, however, when skiing downhill terrain, it is extremely difficult to keep one's heels firmly planted on the ski since one must have his weight forward on the skis to ski properly downhill. Thus, there is no positive engagement of the boot heels with the projection or pad 18 and control of the skis becomes virtually impossible. Accordlingly, with conventional cross-country ski equipment, one typically must ski slowly down a hill or direct his skis at the beginning so that no obstacles will be encountered because turning is so difficult. The present invention overcomes these problems because the skier can shift his weight to plant his heels firmly on the skis even when skiing downhill thereby enabling proper engagement of projection or pad 18 and proper control of the skis.

Figure 3:
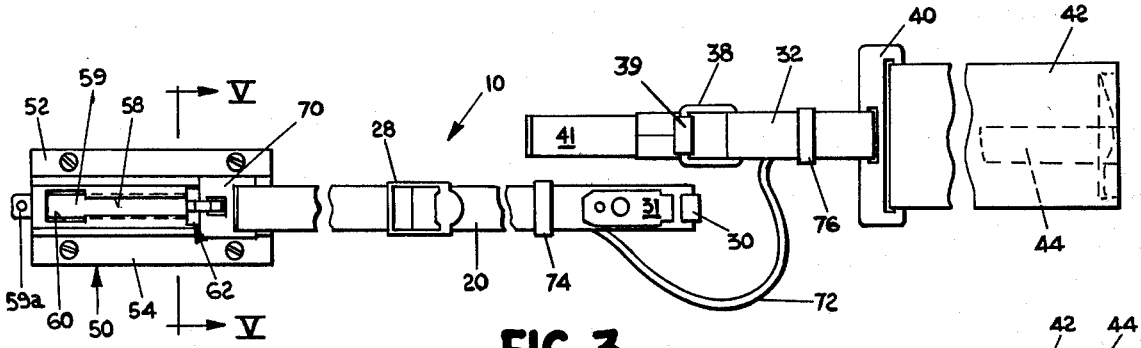
FIG. 3 is a broken, plan view of the strap assembly of the present invention.
Figure 4:
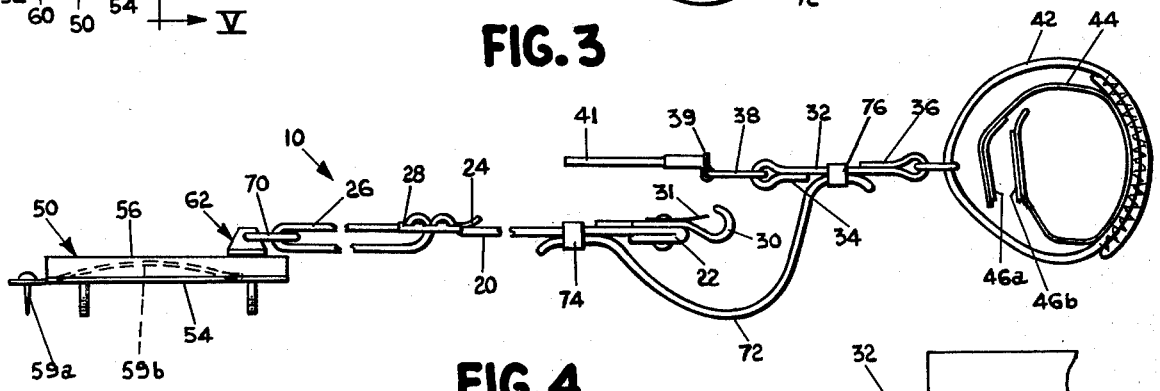
FIG. 4 is a broken, side elevation of the strap assembly of the present invention.

As is best seen in FIGS. 3 and 4, the present invention is a strap assembly including an elongated, flexible nonlongitudinally stretchable strap 20 preferably formed from woven fabric material which is strong, resistant to rot and mildew as well as water. Strap 20 includes an end portion 22 which is doubled over and affixed to a connecting hook 30 as described below. The opposite end of the strap is looped upon itself to form a loop 26 after which the free end 24 is passed through an adjusting buckle 28 for adjustment of the length of the strap 20. A second portion 32 of the elongated, nonlongitudinally stretchable strap includes one end 34 looped over and attached to itself by sewing or the like to secure a connecting link or buckle 38 which is adapted to mate with the connecting hook 30 as described below. The second end 36 of strap section 32 is passed through a correspondingly sized aperture in connecting buckle 40 and looped over and attached to itself again by sewing or the like (FIG. 4).

Connected to another elongated aperture in connecting buckle 40 is a nonstretchable, leg connecting strap 42 formed in the shape of a loop. Leg strap 42 is preferably formed from an elongated section of woven, nonstretchable fabric material having two free ends which are lapped over one another and sewn together as shown in FIGS. 3 and 4. Sewn or otherwise secured to the inside rear surface of leg strap 42 is a flexible elastic securing band or strap 44. Strap 44 includes two free ends, one having a Velcro strip **46*a* on its inside surface and the other free end having a Velcro strip 46*b* on the exterior surface. When the skier's foot is passed through the leg strap 42, and the strap 42 is approximately positioned immediately below the skier's knee, strap 4 is stretched around the skier's leg and its free ends secured together via Velcro strips 46*a*, 46*b*, to hold the leg strap, and thus the end of nonstretchable strap 20, 32** securely in place.

Figure 8:
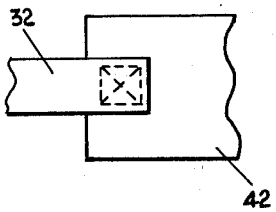
FIG. 8 is a fragmentary view of a portion of an alternative embodiment of the strap assembly shown in FIGS. 3 and 4.

Although leg strap 42 is shown as being secured to nonstretchable strap section 32 by means of connecting buckle 40, strap 32 may also be secured to leg strap 42 by means of sewing or other securing means as shown in FIG. 8.

Figure 5:
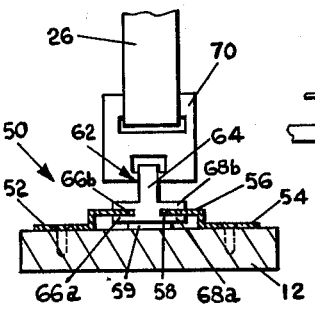
FIG. 5 is a sectional, end elevation of the apparatus for securing the strap to the front area of a ski taken along plane V—V of FIG. 3.

In order to secure the opposite end of nonstretchable strap assembly 10 to the forward portion of a ski, a slotted bracket 50 is provided (FIGS. 3-5). Bracket 50 is preferably elongated and includes a pair of lateral side flanges 52, 54 lying in one plane and a central section 56 raised above the plane of the side flanges. A plurality of screws or other fasteners are passed through flanges 52, 54 to secure the bracket to the ski as shown in FIGS. 1, 2, and 5. Formed in the offset central portion 56 is an elongated slot 58 having an enlarged portion 60 at one end thereof. Slot 58 receives a sliding fastening member 62 including an upstanding central securing portion 64 and two pair of spaced, generally parallel, lateral flanges **66*a*, 66*b* and 68*a*, 68*b*. An arcuate spring member 59 extends within the interior of offset portion 56 from a position external of bracket 50 where it is secured to the ski by its front portion 59*a* with a nail, screw, or other fastener (FIGS. 3–5). Spring member 59 includes a curved central area 59*b* extending adjacent the inside of slot 58 (FIG. 4) to keep sliding member 62 from slipping out of the enlarged end 60 when strap 10 is not under tension. Spring 59 is sufficiently resilient to flex downwardly to allow insertion of member 62 in slot 58. Fastener 62 is connected to a looped end 26 of strap section 20 by means of a second buckle connector 70 having appropriate apertures for receipt of loop 26 and pivotal attachment to portion 64 (FIGS. 4 and 5). Flanges 66, 68 are received in slot 58 through aperture 60 with the edges of slot 58 received between flanges 66***a*, 66*b* and 68*a*, 68*b* (FIG. 5). Fastener 62 slides to the closed end of bracket 50 which is closest to the ski boot bindings when properly secured on the ski.

In order to provide the ability to convert the strap assembly from one which is nonstretchable and supports the legs of the skier when he is skiing downhill terrain to one which is elastic in nature and allows complete freedom of movement for the cross-country skier when he is moving along level or uphill terrain, an elastic band 72 is included as an elastic connecting link between sections 20 and 32 of nonstretchable strap 10. Elastic section 72 is preferably a length of elastic cord which can stretch to three or four times its normal contracted length and is secured to strap sections 20, 32 by means of metallic clamp connectors 74, 76. Connectors 74, 76 clamp the ends of elastic strap 72 against the nonstretchable strap as shown in FIGS. 3 and 4.

When the cross-country skier encounters downhill terrain, he simply connects nonstretchable strap sections 20, 32 together with hook connector 30 and connector buckle 38 to form an elongated, nonstretchable strap assembly as shown in FIG. 1. When the skier is finished with any downhill terrain and encounters level or uphill terrain, he simply disconnects cnnector buckle 38 from hook 30 such that sections 20, 32 are interconnected by means of elastic strap 72. The skier then has complete freedom of movement to move his knees past the normal length of the connected nonstretchable strap and in virtually any direction so that the other types of terrain can be traversed.

As shown in FIGS. 3 and 4, connector hook 30 is revited or otherwise secured to the doubled-over end 22 of strap section 20 and includes a spring member 31 formed from a length of spring steel and extending into the open area of the inside of hook 30. Connector buckle 38 includes a pivotable flange bracket 39 which is adapted to snap into the inside area of hook 30 and be retained therein by the biasing force of spring member 31. In order to disconnect buckle 38 from hook 30, a flexible resilient handle 41 is included such that the flange bracket 39 may be snapped out of engagement with the hook 30 and spring member 31. Such disconnection can be made in the matter of a second or two for each strap thereby obviating any tedious, time-consuming operation to convert between skiing modes using the present invention.

To use the present invention, slide fasteners 62 on the ski ends of nonstretchable strap assemblies 10 are inserted in apertures 60 in brackets 50 and slid to the closed end of slots 58. The skier passes his feet through the loops forming leg straps 42, stretches the elastic straps 44 around his legs immediately below the knee, and secures straps 42 in position therewith with Velcro strips 46*a*, 46*b*. Thereafter, the ski boots are inserted and secured in the conventional, cross-country ski bindings 14 in the conventional manner.

When encountering downhill skiing terrain, the skier connects buckle 38 to hooks 30 to provide a continuous, nonstretchable strap 20, 32 between the front ski portion intermediate the binding area and the front ski tips and the portion of his or her legs immediately below his knees. The strap length is adjusted via buckle 28. The skier can then lean back, shift his weight, and yet remain in proper balance because the straps are secured below the knees, allowing flexing at the knee joints to maintain his upper body in the proper position for correct downhill skiing. Simultaneously, however, weight may be maintained on the heel portions of his boots 16 such that projections or pads 18 are securely engaged. The heels of the boots are thus prevented from sliding laterally with respect to the skis and secure, positive control, and maneuvering of the skis is maintained.

The cross-country skier can lean back to any degree, lie all the way down on the tails of the skis and stand up without aid of his arms or poles, make recoveries after falling, and generally do many tricks which have been previously obtainable only with conventional downhill skiing equipment. Strain on the toe portions of the cross-country type boots is significantly reduced. The weight-back position obtainable with the invention provides greater stability while skiing while encountering varying terrain and snow conditions. Moreover, the connections between each of the skier's legs and the front areas of the skis provides the ability to flex the skis in a curve generally upwardly from the area of the bindings enabling the skier to perform carved turns, snowplow turns, and skid turns in a much easier fashion. This upward curvature also enables better control of the skis in powder and crusty snow conditions, allows the skier to keep ski tips out of holes, and allows him or her to slip over bare spots without falling.

In order to convert to the elastic mode of the invention when level or uphill terrain is encountered, the skier merely pulls upwardly on flexible handles 41 to disconnect buckles 38 from hooks 30. Nonstretchable strap portions 20, 32 are then interconnected by elastic strap 72 which allows complete freedom of movement for the skier to "walk" on his skis to traverse level and uphill cross-country terrain as shown in FIG. 2. The invention may be fitted on new or existing cross-country ski equipment. It extends both the range and scope of cross-country skiing and enables enjoyment of downhill skiing with cross-country equipment in a previously unobtainable manner.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow.

The embodiments of the invention in which an exclusive property or privilege is claimed are defined as follows:

1. A strap assembly for stabilizing and supporting a skier on skis, and especially cross-country skis, comprising:

an elongated, flexible, strap means having opposite ends;

connecting means for connecting one end of said strap means to a ski generally forward of the boot binding on a ski; and attaching means for attaching the other end of said strap means to the leg of a skier generally above his ankle; said strap means including means to cause it to be sufficiently nonstretchable and strong to sustain the weight of a skier when he leans backward to thereby allow the skier to shift his weight backwardly for improved skiing maneuverability without losing his balance, said strap means also being of sufficient length to allow a skier to lean backward to engage and force the rear or heel of his boot securely and firmly against the ski or against a means on the ski to resist lateral movement of the boot on the ski when the strap assembly is used on a ski; and means for selectively making said strap means elastic.

2. A strap assembly for stabilizing and supporting a skier on skis, and especially cross-country skis, comprising:

an elongated, flexible, strap means having opposite ends;

connecting means for connecting one end of said strap means to a ski generally forward of the boot binding on a ski;

attaching means for attaching the other end of said strap means to the leg of a skier generally above his ankle; said strap means including means to cause it to be sufficiently nonstretchable and strong to sustain the weight of a skier when he leans backward to thereby allow the skier to shift his weight backwardly for improved skiing maneuverability without losing his balance;

means for selectively making said strap means elastic;

said strap means includes nonstretchable strap portions; and said means for selectively making said strap means elastic including elastic strap means connected between said nonstretchable strap portions; and second connecting means for connecting said nonstretchable strap means directly together to bypass said elastic strap means when desired.

3. The strap assembly of claim 2 wherein said second connecting means include a hook on one of said nonstretchable strap portions, a buckle adapted to be received in said hook and secured to another of said nonstretchable strap portions, and biasing means for holding said buckle in said hook until forecably pulled and released.

4. The strap assembly of claim 2 wherein said attaching means include a section of said strap means at said other end formed in a continuous loop, said loop being nonstretchable and adapted to fit around the leg of a skier immediately below the skier's knee; said loop including flexible securing means for holding said loop in position along the skier's leg.

5. The strap assembly of claim 4 wherein said loop is secured to another portion of said strap means with a separate intermediate buckle.

6. The strap assembly of claim 4 wherein said loop is sewn to another portion of said strap means.

7. A strap assembly for stabilizing and supporting a skier on skis, and especially cross-country skis, comprising:

an elongated, flexible, strap means having opposite ends;

connecting means for connecting one end of said strap means to a ski generally forward of the boot binding on a ski; and attaching means for attaching the other end of said strap means to the leg of a skier generally above his ankle; said strap means includling means to cause it to be sufficiently nonstretchable and strong to sustain the weight of a skier when he leans backward to thereby allow the skier to shift his weight backwardly for improved skiing maneuverability without losing his balance, said strap means also being of sufficient length of allow a skier to lean backward to engage and force the rear or heel of his boot securely and firmly against the ski or against a means on the ski to resist lateral movement of the boot on the ski when the strap assembly is used on a ski; said attaching means including a section of said strap means at said other end formed in a continuous loop, said loop being nonstretchable and adapted to fit around the leg of a skier immediately below the skier's knee; said loop including flexible securing means for holding said loop in position along the skier's leg; said flexible securing means including an elastic tip strap secured to said loop, said elastic tie strap including a pair of free ends adapted to be fastened about the skier's leg and including means for fastening said free ends together.

8. A strap assembly for stabilizing and supporting a skier on skis, and especially on cross-country skis, comprising an elongated, flexible, longitudinally nonstretchable strap having first and second ends; first securing means on said first strap end for securing said first strap end to a ski generally forward of the binding area of the ski; second securing means on said second strap end for attaching said second strap end to the leg of a skier above his ankle; and elastic strap means secured between adjacent portions of said nonstretchable strap for expansion and contraction with a skier's motion, said elastic strap means including connecting means for connecting portions of said longitudinally nonstretchable strap together to bypass said elastic strap means when desired whereby when connected between a ski and a skier's leg and said elastic means is bypassed, said strap assembly allows the skier to shift his weight to his heels for improved skiing maneuverability, said strap assembly allowing full movement by the skier when said elastic means are not bypassed.

9. The strap assembly of claim 8 including means on said nonstretchable strap for adjusting the length of said strap to accommodate skiers of different size.

10. The strap assembly of claim 8 wherein said connecting means include a slotted bracket having securing means for securing said bracket to a ski and a slide member fastened to said one end of said strap and adapted to be received in said slotted bracket.

11. The strap assembly of claim 8 wherein said attaching means include a section of said nonstretchable strap at said other end formed in a continuous loop, said loop being nonstretchable and adapted to fit around the leg of a skier immediately below the skier's knee; said loop including flexible securing means for holding said loop in position along the skier's leg.

12. A ski assembly comprising:

a ski;

a binding for attaching a ski boot to said ski, said bindling being located intermediate the front tip and rear end portions of said ski;

a strap assembly for stabilizing and supporting a skier on said ski, said strap assembly including an elongated, flexible, longitudinally nonstretchable strap having opposite ends, securing means for securing one end of said strap to said ski generally intermediate said binding and said front tip of said ski, and attaching means for attaching the other of said opposite ends of said strap to the leg of a skier whose ski boot is attached in said binding, said strap being attached to the skier's leg generally above his ankle to allow the skier to shift his weight backwardly for improved skiing maneuverability without losing his balance; and elastic strap means along the length of said nonstretchable strap between portions thereof for expansion and contraction with the skier's leg, said elastic strap means including second connecting means for connecting together portions of said nonstretchable strap to bypass said elastic strap means when desired.

13. A ski assembly comprising:

a ski;

a binding for attaching a ski boot to said ski, said binding being of the cross-country type allowing forward flexure and pivoting of the ski boot whereby the boot heel may be raised off the ski and being located intermediate the front tip and rear end portions of said ski;

a strap assembly for stabilizing and supporting a skier on said ski, said strap assembly including an elongated, flexible, longitudinally nonstretchable strap having opposite ends, securing means for securing one end of said strap to said ski generally intermediate said binding and said front tip of said ski, and attaching means for attaching the other of said opposite ends of said strap to the leg of a skier whose ski boot is attached in said binding, said strap being attached to the skier's leg generally above his ankle to allow the skier to shift his weight backwardly for improved skiing maneuverability without losing his balance; and means on said ski for engaging the rear or heel portion of the ski boot when the skier leans backwardly without losing his balance as allowed by said strap assembly and forces the boot heel toward the ski to resist lateral movement of the boot with respect to the ski but allowing movement of the boot rear or heel away from the ski when such force or pressure is not applied to the boot; said attaching means including a section of said nonstretchable strap at said other end formed in a continuous loop, said loop being nonstretchable and adapted to fit around the leg of a skier immediately below the skier's knee; said loop including flexible securing means for holding said loop in position along the skier's leg; said flexible securing means including an elastic tie strap secured to said loop, said elastic tie strap including a pair of free ends adapted to be fastened about the skier's leg and including means for fastening said free ends together.

14. A strap assembly for stabilizing and supporting a skier on skis, and especially cross-country skis, comprising:

an elongated, flexible, strap means having opposite ends;

connecting means for connecting one end of said strap means to a ski generally forward of the boot binding on a ski; and attaching means for attaching the other end of said strap means to the leg of a skier generally above his ankle; said strap means including means to cause it to be sufficiently nonstretchable and strong to sustain the weight of a skier when he leans backward to thereby allow the skier to shift his weight backwardly for improved skiing maneuverability without losing his balance;

said attaching means including a nonstretchable strap formed in a loop which is larger than the leg of the skier and securing strap means for holding said nonstretchable loop at a predetermined position on the skier's leg, said securing strap means being on said nonstretchable loop and adapted to fit snugly around the skier's leg, said nonstretchable loop adapted to extend in the same downwardly angled direction toward said connecting means and as a continuation of said elongated, nonstretchable strap means when in use while said securing means remain positioned generally around and transverse to the skier's leg when in use.

* * * * *

UNITED STATES PATENT AND TRADEMARK OFFICE

CERTIFICATE OF CORRECTION

PATENT NO. : 3,994,511

DATED : November 30, 1976

INVENTOR(S) : George W. Gronseth

It is certified that error appears in the above–identified patent and that said Letters Patent are hereby corrected as shown below:

Column 2, line 14;
"are" should be --area--;
Column 3, line 28;
"corss-country" should be --cross-country--;
Column 3, line 60;
"Accordlingly" should be --Accordingly--;
Column 4, line 34;
"4" should be --44--;
Column 5, line 28;
"cnnector" should be --connector--;
Column 5, line 36;
"revited" should be --riveted--;
Column 7, line 36;
"forecably" should be --forceably--;
Column 7, line 60;
"includling" should be --including--;
Column 8, line 10;
"tip" should be --tie--;
Column 8, line 54;
"bindling" should be --binding--.

Signed and Sealed this

Fifth Day of April 1977

[SEAL]

*Attest:*

RUTH C. MASON
*Attesting Officer*

C. MARSHALL DANN
*Commissioner of Patents and Trademarks*